US011596825B1

(12) United States Patent
Breeze

(10) Patent No.: US 11,596,825 B1
(45) Date of Patent: Mar. 7, 2023

(54) WEIGHTED FITNESS HOOP

(71) Applicant: Nevada Breeze, Pasadena, CA (US)

(72) Inventor: Nevada Breeze, Pasadena, CA (US)

( * ) Notice: Subject to any disclaimer, the term of this patent is extended or adjusted under 35 U.S.C. 154(b) by 0 days.

(21) Appl. No.: 17/475,373

(22) Filed: Sep. 15, 2021

(51) Int. Cl.
*A63B 19/02* (2006.01)
*A63B 21/06* (2006.01)

(52) U.S. Cl.
CPC ..... *A63B 19/02* (2013.01); *A63B 21/0608* (2013.01); *A63B 2225/74* (2020.08)

(58) Field of Classification Search
CPC .. A63B 19/02; A63B 21/0608; A63B 2225/74
See application file for complete search history.

(56) References Cited

U.S. PATENT DOCUMENTS 3,918,708 A * 11/1975 Augusta ..... A63H 33/22 84/477 B
4,915,666 A * 4/1990 Maleyko ..... A63B 19/00 446/490
5,083,964 A * 1/1992 Arad ..... A63B 19/00 446/28
5,538,454 A * 7/1996 Kessler ..... A63B 19/00 446/28
5,569,134 A * 10/1996 Nordanger ..... A63B 19/00 446/236
5,823,846 A * 10/1998 Arriola ..... A63B 19/00 446/236
6,450,854 B1 * 9/2002 Fireman ..... A63B 21/0602 446/28
6,482,136 B1 * 11/2002 Kessler ..... A63B 21/0602 446/28
6,494,760 B1 * 12/2002 Kessler ..... B29C 66/1122 446/236
6,890,238 B2 * 5/2005 Kessler ..... A63B 19/00 446/236
9,468,790 B1 * 10/2016 Snead ..... B32B 7/00
10,420,979 B2 * 9/2019 Estrada, Jr. ..... A63B 21/0603
2010/0029446 A1 * 2/2010 Munoz ..... A63B 19/00 482/78
2013/0225037 A1 * 8/2013 Deluz ..... A63B 19/00 446/242
2015/0273260 A1 * 10/2015 Hotchkis ..... A63B 19/00 482/23
2016/0279470 A1 * 9/2016 Campbell ..... A63B 19/00
2016/0332018 A1 * 11/2016 Granat ..... H05B 45/00
2019/0291017 A1 * 9/2019 Yohannes ..... A63H 33/26

* cited by examiner

*Primary Examiner* — Andrew S Lo
(74) *Attorney, Agent, or Firm* — Ted Masters

(57) ABSTRACT

A weighted fitness hoop apparatus for cardiovascular and resistance exercise. The hoop comprises an elliptical tubular sheath with two end portions, the ends selectively engageable by a coupler. A hollow core extends through the length of the tubular sheath and is optionally fillable with a weight or light. The coupler is insertably engaged with the hollow core at the first and second ends of the elliptical tubular sheath, and the power source for the light is removably attached to surface of the hoop.

9 Claims, 9 Drawing Sheets

WEIGHTED FITNESS HOOP

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally relates to a weighted fitness hoop device used for cardiovascular exercise and resistance training.

2. Description of the Related Art

The advent of the Hula hoop in the 50's jump started popularity in hoop fitness devices ever since. Whether for exercise or for pure fun, many enjoy using hoops for their simplicity, as most hoops are simply grab-and-go with no setup time.

The public has enjoyed hoops with a variety of features, such as hoops with different cross-sectional profiles so that the hoop can grasp the body in novel ways as it revolves around the user, as well as hoops that are selectively deconstructable by segments for easy transport. What is needed in the art is a large and heavy fitness hoop that is selectively openable and fillable with a variety of weights and entertainment features that is strong enough to not fall apart during operation.

BRIEF SUMMARY

The present disclosure specifically addresses and alleviates the above-identified deficiencies in the art. In this regard, the disclosure is directed to a weighted fitness hoop. Generally, a weighted fitness hoop includes an elliptical tubular sheath that is either circular or oval in shape. A hollow core extends through the entire length of the sheath, and is fillable with a weight, or other features, such as light. As such, the total weight of the weighted fitness hoop may be adjusted to the user's liking. A coupler joins the ends of the sheath together. A coupler may be in the form of a generally hollow tube or solid plug.

Embodiments of the present disclosure use different configurations of a coupler to connect the ends of the sheath. In some configurations, securing holes within the coupler and sheath may be filled with clips.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and the detailed description to indicate the same elements.

DETAILED DESCRIPTION

The detailed description set forth below in connection with the appended drawings is intended as a description of some, but not all, of contemplated embodiments of the disclosure, and is not intended to represent the only form in which the present disclosure may be constructed or utilized. The description sets forth the functions and the sequence of steps for developing and operating the disclosure in connection with the illustrated embodiments.

It is to be understood, however, that the same or equivalent functions and sequences may be accomplished by different embodiments that are also intended to be encompassed within the spirit and scope of the disclosure. It is further understood that the use of relational terms such as first and second, top and bottom, and the like are used solely to distinguish one entity from another entity without necessarily requiring or implying any actual such relationship or order between such entities.

Figure 1:
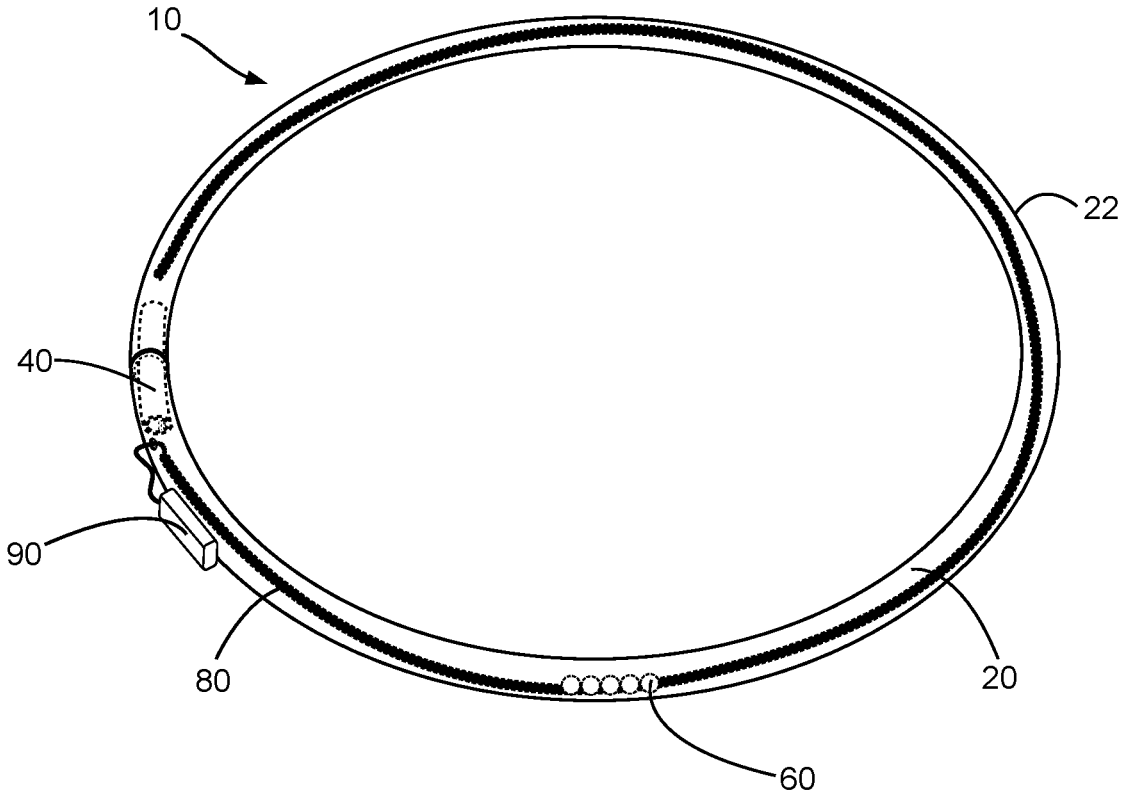
FIG. 1 is an upper perspective view of an embodiment of a weighted fitness hoop.

Referring to FIG. 1, an upper perspective view of an embodiment of a weighted fitness hoop 10 in accordance with an aspect of the present disclosure is illustrated. As an exemplary embodiment, the weighted fitness hoop 10 of FIG. 1 comprises an elliptical tubular sheath 20, a coupler 40, a weight 60, a light 80, and a power source 90. The weighted fitness hoop 10 may be used for cardiovascular or resistance exercise by gyration about and in contact with a person's body.

Figure 2:
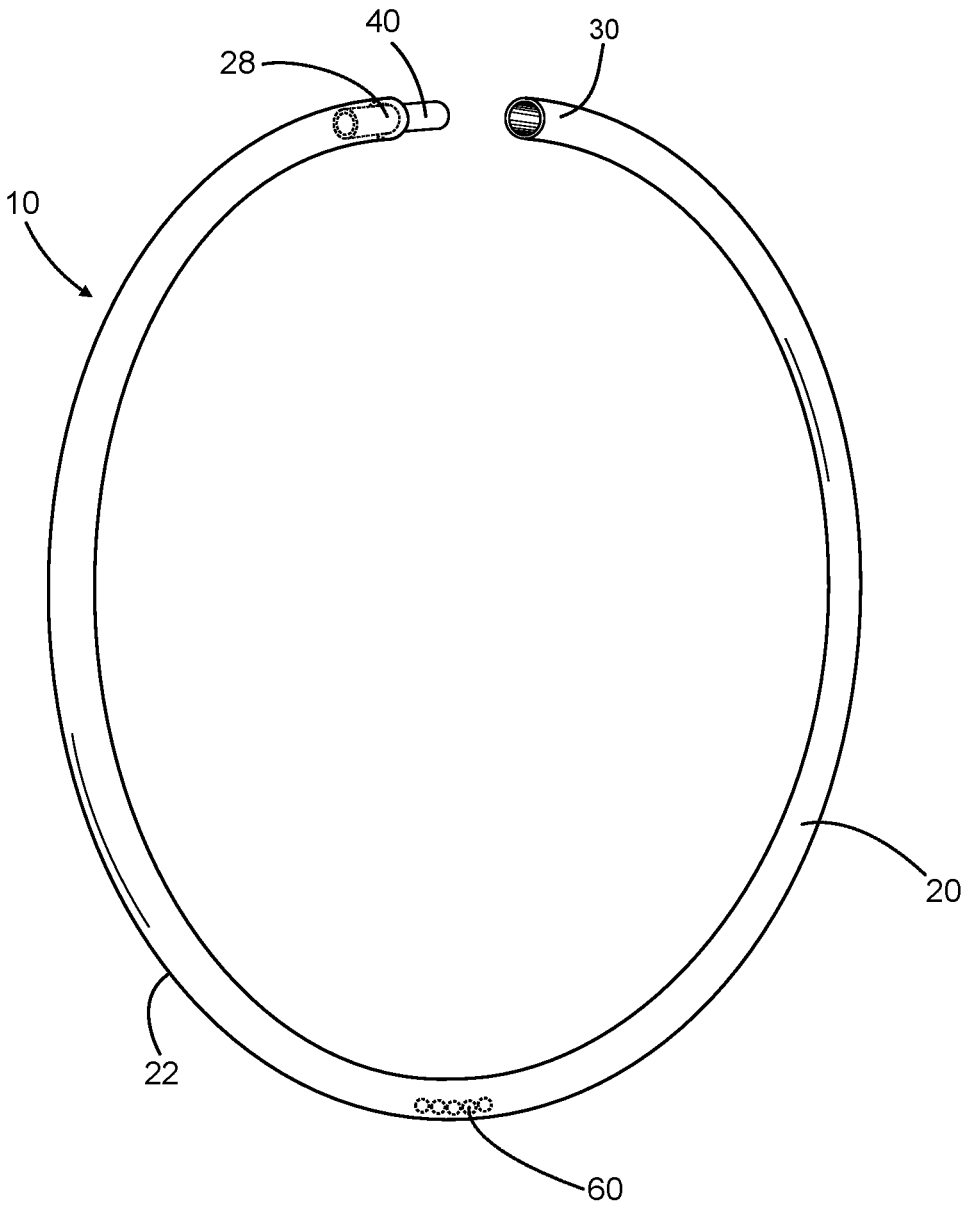
FIG. 2 is a side perspective view of an embodiment of a weighted fitness hoop.

Referring to FIG. 2, a side perspective view of an embodiment of a weighted fitness hoop 10, the elliptical tubular sheath 20 includes an outer surface 22 and a hollow core 24, the hollow core 24 extending the entire length of the elliptical tubular sheath 20. The hollow core 24 further defines an inner core surface 26 of the elliptical tubular sheath 20. The elliptical tubular sheath 20 further includes a first end portion 28 at one end and a second end portion 30 at the opposite end where the end portions of a coupler 40 may be insertably received.

Figure 3:
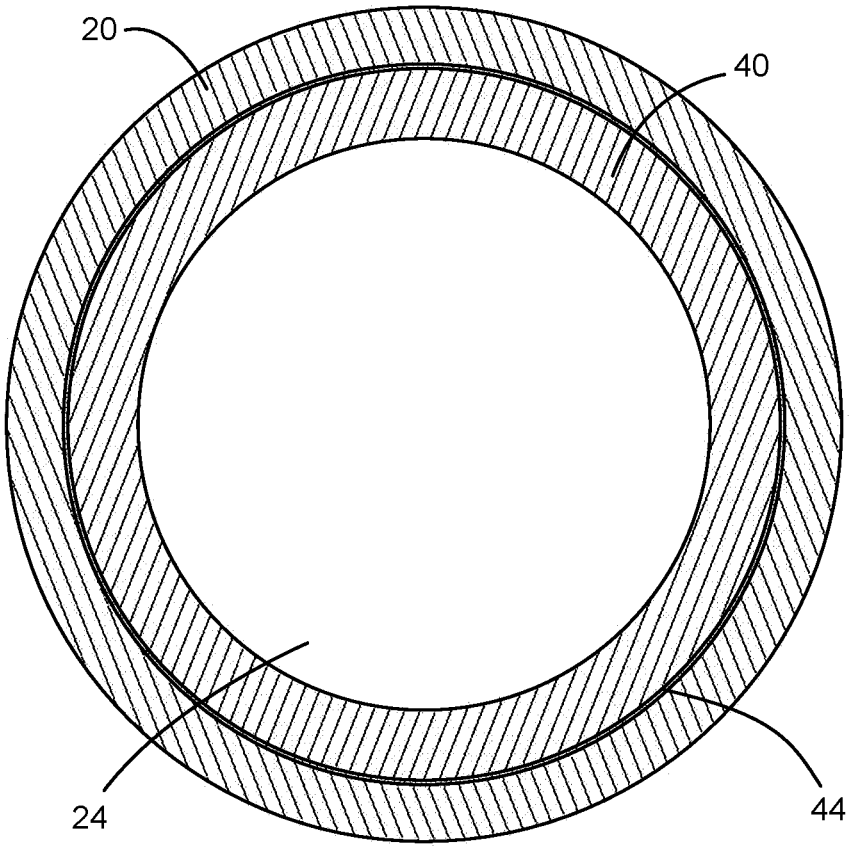
FIG. 3 is a front cross-sectional view of a weighted fitness hoop wherein a portion of a coupler is insertably attached within an end portion of an elliptical tubular sheath.

Now referring to FIGS. 2 and 3, the elliptical tubular sheath 20 has a circular cross-sectional shape. It is contemplated that the elliptical tubular sheath 20 may be constructed from a thermoplastic polymer, rubber, metal, or any other material that may be appreciated by one of ordinary skill of the art that does not depart from the spirit of the present disclosure. It is contemplated that the elliptical tubular sheath 20 may be constructed from translucent material allowing the user to see that objects are disposed within the hollow core 24 in various embodiments of a weighted fitness hoop 10. It is also contemplated that the elliptical tubular sheath 20, alternatively, may be constructed of transparent material, to allow a user to see objects disposed within the hollow core 24 clearly. It is further contemplated that the elliptical tubular sheath 20 may be at least approximately 12.5 feet long, to form a large hoop for a larger user such as an adult, or alternatively may have a length of 10 feet to accommodate smaller users. In contemplated embodiments, the elliptical tubular sheath 20 is formed from PVC tubing or piping having a one-inch inner diameter, or alternatively a one-inch outer diameter. Additionally, while FIGS. 2 and 3 depict a sheath having a circular cross-sectional shape, the cross-sectional shape may also be oval.

Continuing to refer to both FIGS. 2 and 3, a weighted fitness hoop 10 includes a coupler 40, the coupler having a circular configuration along a longitudinal axis, so as to resemble a traditional pipe or tube and having a circular cross-sectional shape. The coupler 40 is of a dimensional size smaller than the hollow core 24 of the elliptical tubular sheath 20 to allow the coupler to be insertably coupled with either the first end portion 28 or second end portion 30 of the elliptical tubular sheath 20. The coupler 40 may be constructed from a thermosetting polymer, thermoplastic polymer, metal, or wood. By way of example and not limitation, a coupler 40 may be formed from a segment of metal pipe having a length of approximately 4 to 8 inches for the purpose of advantageously increasing the overall weight of the weighted fitness hoop 10.

To clarify how a coupler 40 may engage with an elliptical tubular sheath 20, FIG. 3 shows a front cross-sectional view of a coupler 40 slidably disposed within an elliptical tubular sheath 20. The coupler 40 is affixed to the elliptical tubular sheath 20 by an adhesive layer 44 between a coupler surface 42 and inner core surface 26 of an elliptical tubular sheath 20. It is contemplated that the adhesive layer 44 may be either permanent or removable, where removable adhesive allows the user to decouple the coupler 40 while not damaging either the coupler 40 or the elliptical tubular sheath 20. The adhesive layer 44 has a thickness that does not prevent the coupler 40 from being insertably engaged into the elliptical tubular sheath 20.

Figure 4:
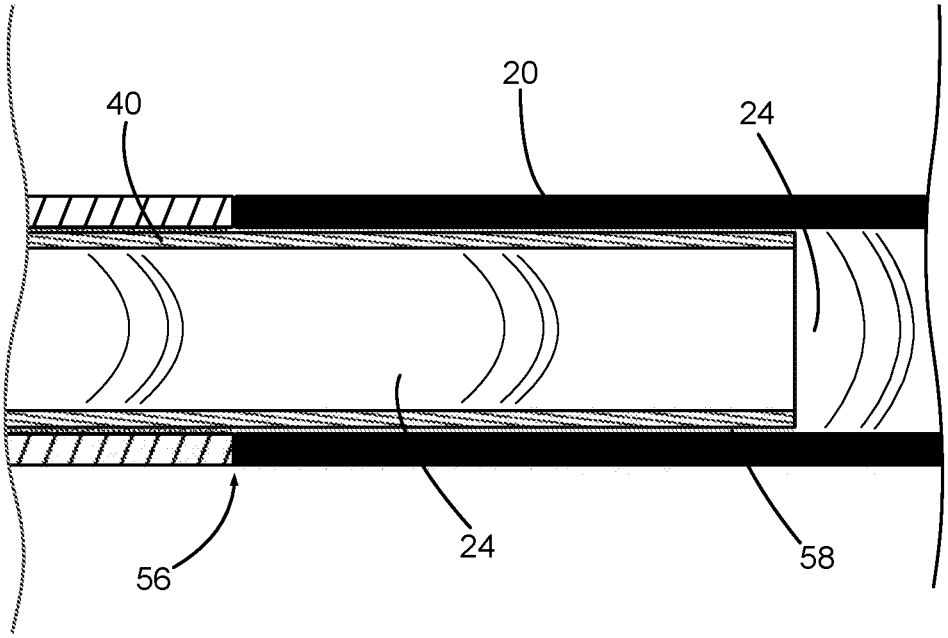
FIG. 4 is a side cross-sectional view of a segment of a weighted fitness hoop having a coupler insertably disposed within a hollow core.

FIG. 4 provides a side cross-sectional view of an embodiment of a weighted fitness hoop 10 in the vicinity of an interface 56 of first end portion 28 and second end portion 30 of an elliptical tubular sheath. The weighted fitness hoop 10 includes an alternate configuration of a coupler 40 insertably disposed within an elliptical tubular sheath 20. FIG. 4 shows an embodiment of a coupler 40 having an end insertably coupled within a first end portion 28 of an elliptical tubular sheath 20 with the aid of an adhesive layer 44, the adhesive layer 44 being disposed between a coupler surface 42 and an inner core surface 26 of the elliptical tubular sheath 20. The opposite end of the coupler 40 is removably coupled with a second end portion 30 of the elliptical tubular sheath 20 by friction forces 58 without adhesive, allowing the user to open the weighted fitness hoop 10 and access the contents within.

Figure 5:
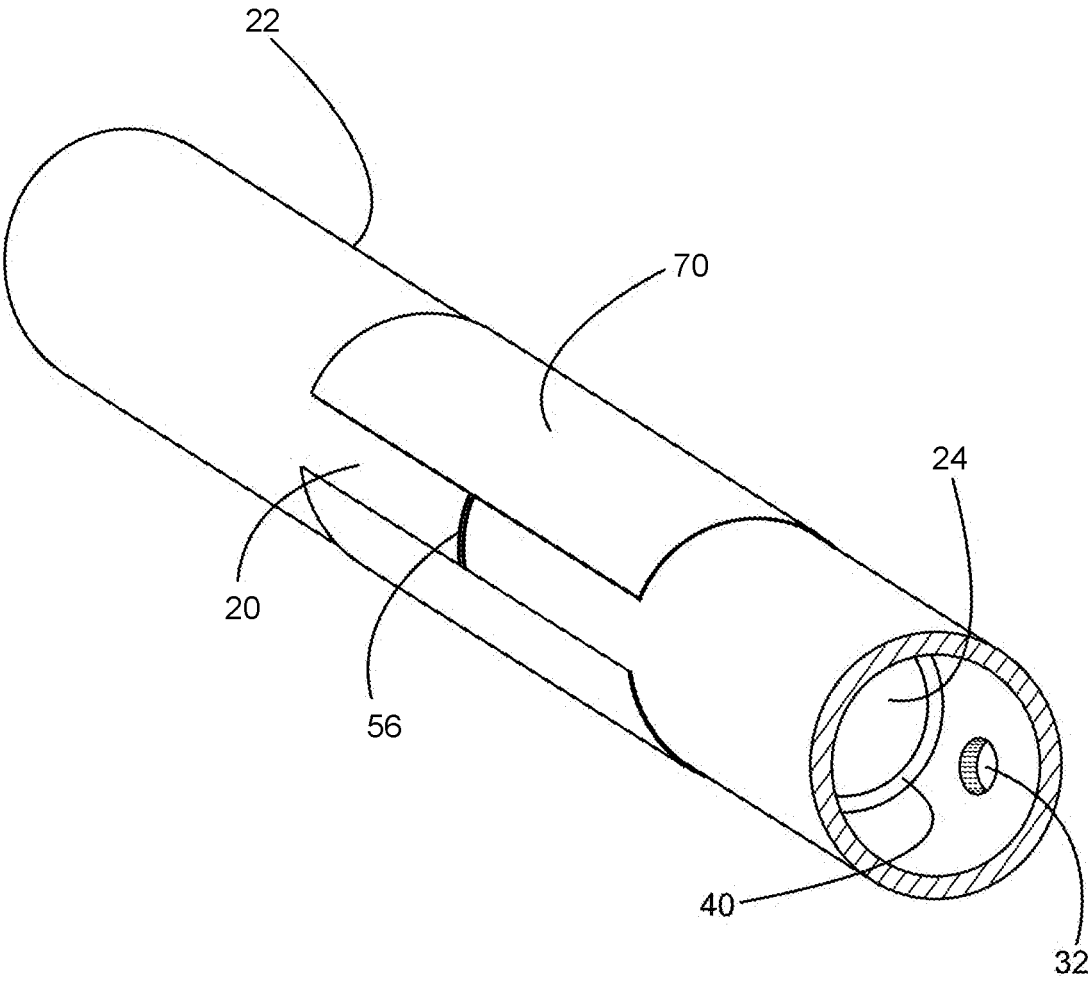
FIG. 5 is an upper perspective view of a portion of a weighted fitness hoop including a patch covering the outer surfaces of first and second end portions of an elliptical tubular sheath.

FIG. 5 depicts a segment of another embodiment of a weighted fitness hoop 10 in the vicinity of an interface 56 of a first end portion 28 and a second end portion 30 of an elliptical tubular sheath 20. The weighted fitness hoop of FIG. 5 includes a patch 70 for at least partially covering the interface 56 of the weighted fitness hoop 10. The patch 70 is a sheet having two faces; an adhesive face and a non-adhesive face. The adhesive face of the patch 70 is affixed to and covers portions of outer surfaces 22 of the first end portion 28 and second end portion 30 of the elliptical tubular sheath 20. It is contemplated that a patch 70 may be dimensioned to allow it to cover at least the full circumference of the cross-sectional shape of the elliptical tubular sheath 20 to cover the interface 56 entirely and promote a stronger coupling. Some embodiments of an elliptical tubular sheath 20 may also include an opening 32 within the elliptical tubular sheath 20 to pass chords or wires into the hollow core 24 or generally provide access to the hollow core 24. By way of example and not limitation, it is contemplated that the patch 70 may be dimensioned to cover only a portion of the circumference of the elliptical tubular sheath 20, or the patch may be in the shape approximating a square with sides measuring four inches. By way of example and not limitation, it is further contemplated that the adhesive on the patch 70 may be a permanent adhesive, or alternatively a removable adhesive to allow removal of the patch 70 and decoupling of the first end portion 28 and second end portion 30 of the tubular elliptical sheath 20.

Figure 6:
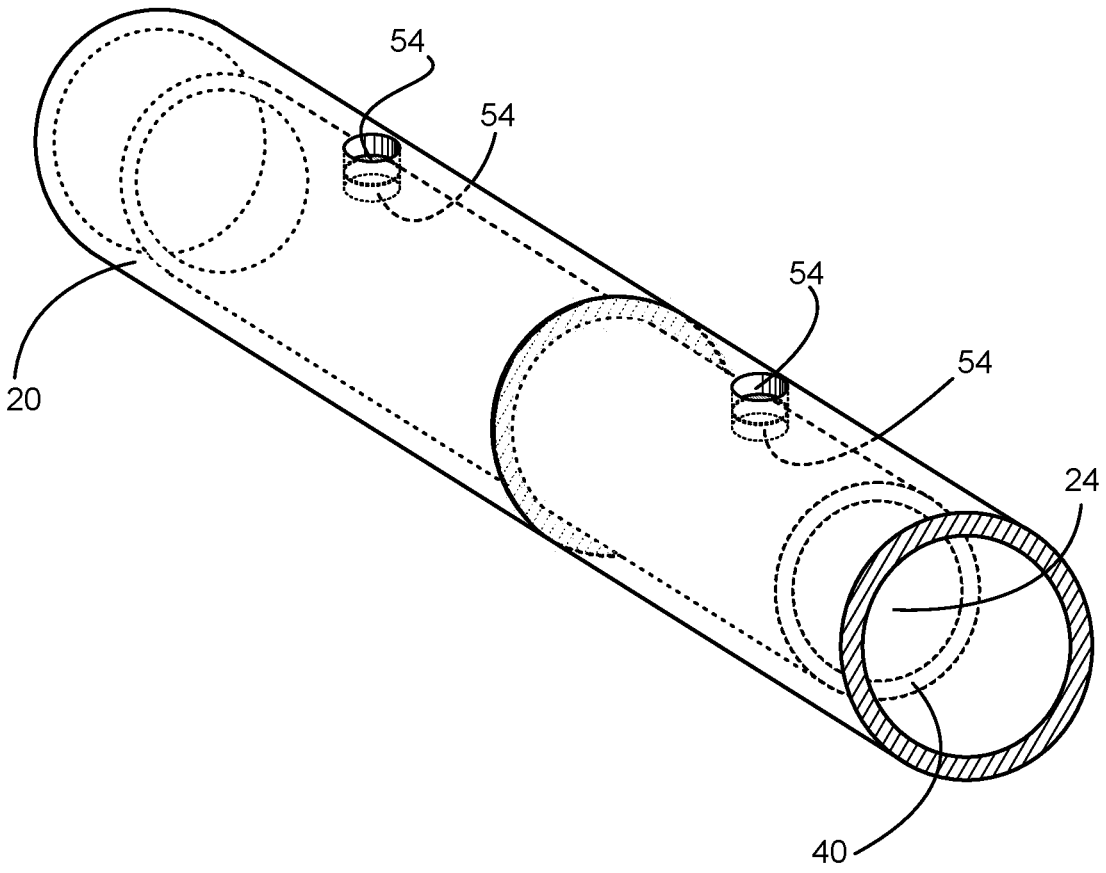
FIG. 6 is an upper perspective view of a coupler insertably disposed within an elliptical tubular sheath such that the securing holes of the coupler align with securing holes of the elliptical tubular sheath.

FIG. 6 illustrates an embodiment of a weighted fitness hoop 10 that includes securing holes 54 at a first end portion 28 and a second end portion 30 of a tubular elliptical sheath 20 which generally overlap and align with similarly-arranged securing holes 54 included in a coupler 40. The securing holes 54 are positioned in-line with one another and are at the same angular position along a longitudinal axis of the elliptical tubular sheath 20. Rigid objects may be disposed within the pairs of securing holes 54 to prevent slipping between the coupler 40 and the elliptical tubular sheath 20 along a longitudinal axis of the elliptical tubular sheath 20.

Figure 7:
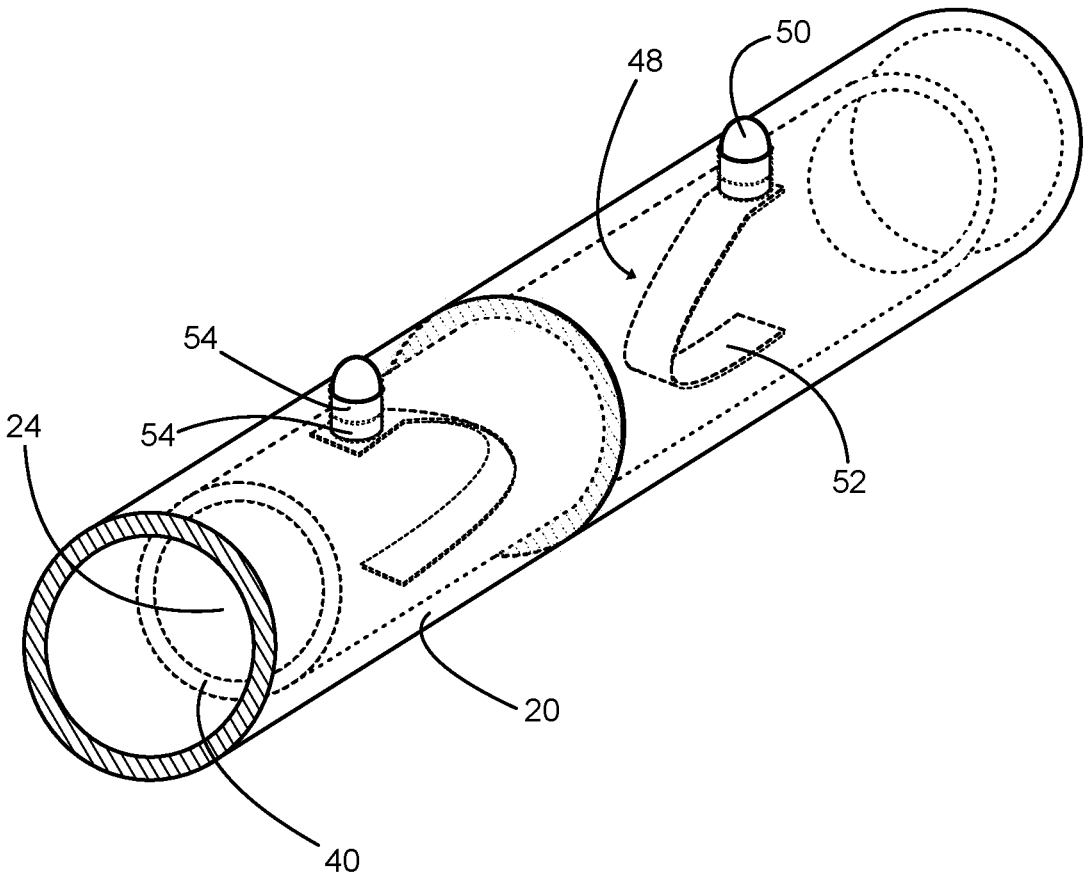
FIG. 7 is an upper perspective view of a portion of a weighted fitness hoop that includes a coupler having spring clips insertably disposed within.

FIG. 7 provides an exemplary embodiment of a weighted fitness hoop 10 having spring clips 48 slidably disposed within the coupler 40. The spring clips 48 have clip heads 50 that, from a restoring force applied by the spring clip body 52, protrude through the securing holes 54 within the coupler 40 and elliptical tubular sheath 20 to prevent slipping between the coupler 40 and the elliptical tubular sheath 20, and to prevent the weighted fitness hoop 10 from becoming decoupled. Along the axis of compressing operation and when not compressed, the spring clips 48 have a dimensional size bigger than the diameter of the hollow core 24.

It is contemplated that the spring clip body 52 may be made of any elastically deformable material that restores its form upon compression, such as an elastically deformable metal, an elastically deformable metal alloy, or an elastically deformable polymer. The clip head 50 is formed from a rigid material that resists deformation, such as metal, a metal alloy, a thermosetting polymer, or any other material that may be appreciated by one of ordinary skill of the art.

Figure 8:
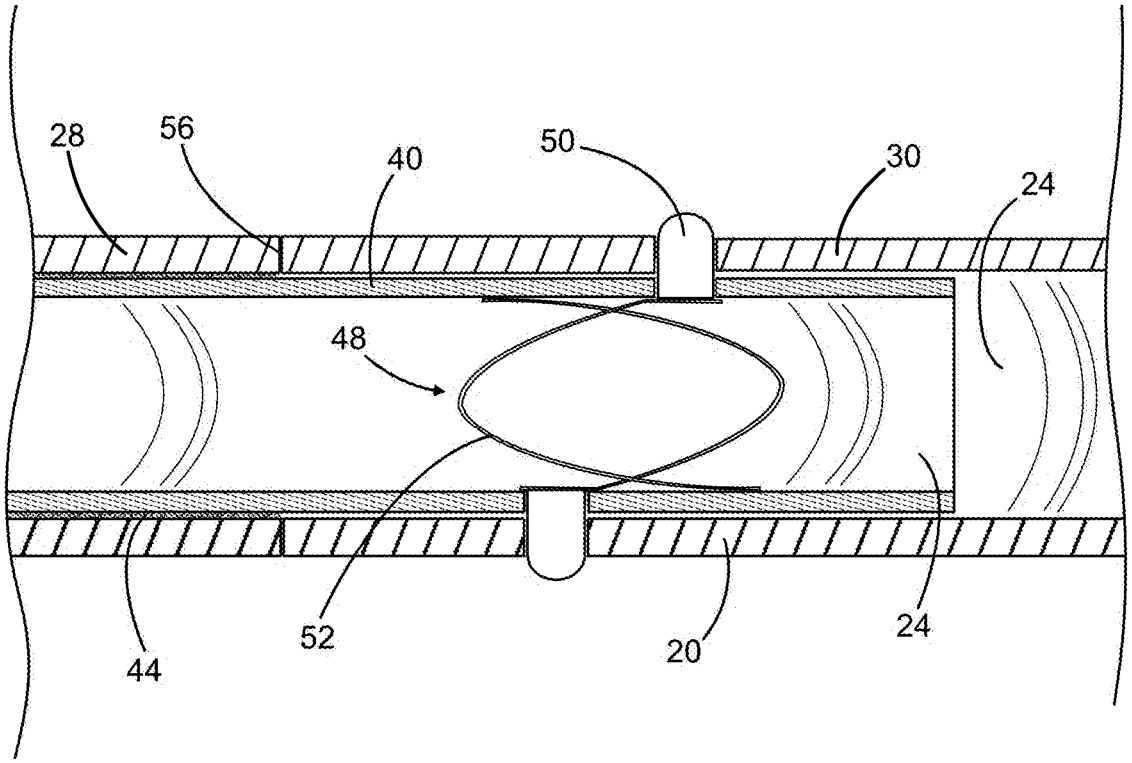
FIG. 8 is a side cross-sectional view of a portion of a weighted fitness hoop that includes an alternate embodiment of a coupler having a pair of clips insertably disposed within.

Referring to FIG. 8, a side cross-sectional view of an alternate configuration of spring clips 48 disposed within a weighted fitness hoop 10 is provided. An end of the coupler 40 may be insertably affixed within a first end portion 28 of an elliptical tubular sheath 20 by an adhesive layer 44 and the other end of the coupler 40 may be insertably disposed within the second end portion 30 of the elliptical tubular sheath 20 without an adhesive layer 44. The coupler 40 end that is disposed within the second end portion 30 of the sheath 20 may be secured with two spring clips 48, the spring clips 48 having a 180-degree rotational orientation with respect to each other about a longitudinal axis of the elliptical tubular sheath 20 and having clip heads 50 that are disposed through securing holes 54 in the coupler 40 and elliptical tubular sheath 20 with the same 180-degree orientation.

Referring to FIGS. 1 and 2, another embodiment of the present disclosure includes a weight 60 disposed within the hollow core 24 of the elliptical tubular sheath 20. The weight adds weight to the weighted fitness hoop 10, providing the benefit of a more challenging exercise. The weight 60 has a smaller dimensional size than the dimensional size of the hollow core 24 of the elliptical tubular sheath 20. It is contemplated that the weight may move freely within the hollow core 24, causing a rhythmic sound as the weight 60 makes impact with features within the hollow core 24 as the user rotates the weighted fitness hoop 10. It is also contemplated that the weight 60 may be secured within the hollow core 24 to prevent movement of the weight 60. It is further contemplated that the weight 60 may be a single mass, or multiple masses disposed within the hollow core 24. In a preferred embodiment, the weight 60 is multiple one-fourth inch metal balls that can provide a distinct and enjoyable rattling sound while the weighted fitness hoop 10 is in use.

The weight 60 may be formed from a rigid or semi-rigid material that resists breaking under impact, such as metal, a metal alloy, a thermosetting polymer, or any other material that may be appreciated by one of ordinary skill of the art. By way of example and not limitation, the weight 60 may be one or more spherical masses formed from a rigid or semi-rigid material, such as metal bearings, glass marbles.

Figure 9:
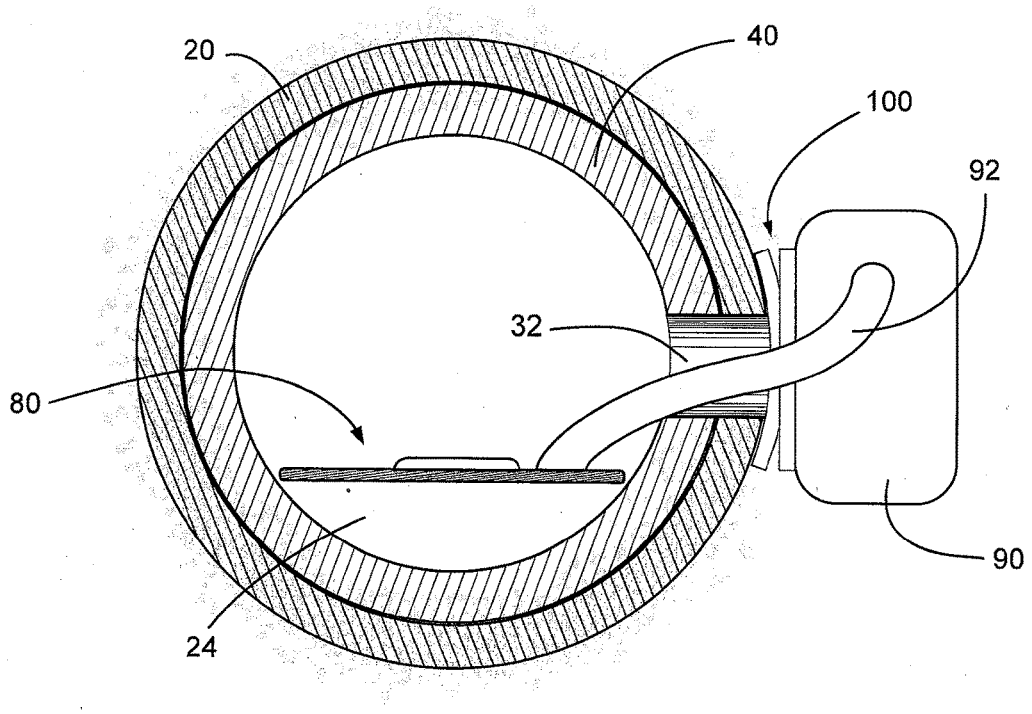
FIG. 9 is a front cross-sectional view of a weighted fitness hoop that includes a power source removably coupled to an outer surface of an elliptical tubular sheath and a light disposed within a hollow core.

FIGS. 1 and 9 illustrate an embodiment of the present disclosure that includes a light 80 insertably disposed within a hollow core 24 of an elliptical tubular sheath 20. The embodiment also includes a power source 90 secured by a securing means 100 to an outer surface 22 of the elliptical tubular sheath 20 and in electrical connection with the light 80 by a wire 92, the wire being insertably disposed through an opening 32 in the elliptical tubular sheath 20. The embodiment of FIG. 9 includes a power source 90 where the corresponding securing means 100 is a 2-piece hook-and-loop strip with adhesive faces attached to the outer surface 22 of the tubular elliptical sheath 20 and the power source 90 and with hook-and-loop faces in operable contact with each other. In an alternative embodiment of the present disclosure, the power source 90 may be secured to the outer surface 22 by wrapping a hook-and-loop strap, or Velcro® strap around the power source 90 and elliptical tubular sheath 20.

Additionally, and by way of example and not limitation, the light 80 may include one or more lights in electrical connection with each other, such as a strip of light emitting diodes. It is contemplated that when an embodiment of a weighted fitness hoop 10 includes a light 80, the weighted fitness hoop 10 may also include an elliptical tubular sheath 20 formed from either a translucent or transparent material to allow a user to see objects disposed within the hollow core 24. It is contemplated that the elliptical tubular sheath 20 may be formed from a length of transparent or translucent pipe or tubing made from polyvinyl chloride pipe (PVC), acrylic, polycarbonate, or any other material that may be appreciated by one of ordinary skill of the art that does not depart from the spirit of the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, the description taken with the drawings making apparent to those skilled in the art how the several forms of the present disclosure may be embodied in practice.

What is claimed is:

1. A weighted fitness hoop comprising:

an elliptical tubular sheath, comprising:

a first end portion, a second end portion, and an outer surface;

a hollow core continuously disposed within the elliptical tubular sheath and defining an inner core surface;

a coupler, the coupler being insertably disposed within the first and second end portions of the elliptical tubular sheath;

a weight disposed within the hollow core of the elliptical tubular sheath;

a light insertably disposed within the hollow core of the elliptical tubular sheath; and a power source, the power source in electrical connection with the light, and the power source removably attached to the outer surface of the elliptical tubular sheath.

2. A weighted fitness hoop comprising:

an elliptical tubular sheath, comprising:

a first end portion, a second end portion, and an outer surface;

a hollow core continuously disposed within the elliptical tubular sheath and defining an inner core surface;

a coupler, the coupler being insertably disposed within the first and second end portions of the elliptical tubular sheath;

a weight disposed within the hollow core of the elliptical tubular sheath;

wherein one end of the coupler is insertably attached within the first end portion of the elliptical tubular sheath by an adhesive layer disposed between the coupler and the inner core surface;

a light insertably disposed within the hollow core of the elliptical tubular sheath; and a power source, the power source in electrical connection with the light, and the power source removably attached to the outer surface of the elliptical tubular sheath.

3. A weighted fitness hoop comprising:

an elliptical tubular sheath, comprising:

a first end portion, a second end portion, and an outer surface;

a hollow core continuously disposed within the elliptical tubular sheath and defining an inner core surface;

a coupler, the coupler being insertably disposed within the first and second end portions of the elliptical tubular sheath;

a weight disposed within the hollow core of the elliptical tubular sheath;

at least one securing hole disposed within each end of the coupler, the securing holes positioned in-line with one another at the same angular position along a longitudinal axis of the elliptical tubular sheath;

at least one securing hole disposed within the first end portion of the elliptical tubular sheath and at least one securing hole disposed within the second end portion of the elliptical tubular sheath, the securing holes positioned in-line with one another and alignable with the securing holes within the coupler; and at least one spring clip insertably disposed within each end of the coupler.

4. The weighted fitness hoop of claim 3, further comprising:

a light insertably disposed within the hollow core of the elliptical tubular sheath; and a power source, the power source in electrical connection with the light and the power source removably coupled to the outer surface of the elliptical tubular sheath.

5. A weighted fitness hoop comprising:

an elliptical tubular sheath, comprising:

a first end portion, a second end portion, and an outer surface;

a hollow core continuously disposed within the elliptical tubular sheath and defining an inner core surface;

a coupler, the coupler being insertable disposed within the first and second end portions of the elliptical tubular sheath;

a weight disposed within the hollow core of the elliptical tubular sheath;

wherein an end of the coupler is insertably disposed within the first end portion of the elliptical tubular sheath;

an opposite end of the coupler is insertably disposed within the second end portion of the elliptical tubular sheath, the opposite end of the coupler includes two diametrically opposed securing holes disposed within;

the second end portion of the tubular elliptical sheath includes two diametrically opposed securing holes disposed within; and at least one spring clip is insertably disposed within the opposite end of the coupler.

6. The weighted fitness hoop of claim 5, wherein one end of the coupler is insertably attached within the first end portion of the elliptical tubular sheath by an adhesive layer disposed between the coupler and the inner core surface.

7. The weighted fitness hoop of claim 5, further comprising:

a light insertably disposed within the hollow core of the elliptical tubular sheath; and a power source, the power source being in electrical connection with the light and the power source being removably coupled to the outer surface of the elliptical tubular sheath.

8. A weighted fitness hoop comprising:

an elliptical tubular sheath comprising:

a first end portion, a second end portion, and an outer surface;

a hollow core continuously disposed within the elliptical tubular sheath and defining an inner core surface;

a coupler comprising at least one securing hole disposed within each end of the coupler, the securing holes positioned in-line with one another at the same angular position along a longitudinal axis of the elliptical tubular sheath, and the coupler being insertably disposed within the first and second end portions of the elliptical tubular sheath;

at least one spring clip insertably disposed within each end of the coupler;

a weight comprising at least one metal ball having a diameter of one quarter inch disposed within the hollow core of the elliptical tubular sheath;

a light insertably disposed within the hollow core of the elliptical tubular sheath; and a power source, the power source in electrical connection with the light, and the power source removably coupled with the outer surface of the elliptical tubular sheath.

9. The weighted fitness hoop of claim 8, wherein the elliptical tubular sheath has a length of twelve and a half feet.

* * * * *